US006739059B2

(12) United States Patent
Bollinger et al.

(10) Patent No.: US 6,739,059 B2
(45) Date of Patent: May 25, 2004

(54) CUTTING TOOL WITH LINEAR OSCILLATING DRIVE

(75) Inventors: Heinrich Bollinger, Thayngen (CH); Max Keller, Schaffhausen (CH)

(73) Assignee: Biax-Maschinen GmbH, Steckborn (CH)

( * ) Notice: Subject to any disclaimer, the term of this patent is extended or adjusted under 35 U.S.C. 154(b) by 73 days.

(21) Appl. No.: 10/078,110

(22) Filed: Feb. 20, 2002

(65) Prior Publication Data

US 2002/0112356 A1 Aug. 22, 2002

(30) Foreign Application Priority Data

Feb. 20, 2001 (CH) ..... 0297/01
May 7, 2001 (DE) ..... 201 07 716 U

(51) Int. Cl.[7] ..... B26B 7/00
(52) U.S. Cl. ..... 30/277.4; 30/392
(58) Field of Search ..... 30/392, 393, 277.4, 30/329, 332, 334, 272.1

(56) References Cited

U.S. PATENT DOCUMENTS 2,781,578 A * 2/1957 Quilfoyle ..... 30/277.4
3,260,289 A * 7/1966 Whitten, Jr. ..... 30/392
3,359,637 A * 12/1967 Hansen ..... 30/277.4
3,417,469 A * 12/1968 Cousins et al. ..... 30/277.4
5,615,746 A * 4/1997 Chu ..... 30/272.1
5,640,772 A 6/1997 Roeker et al.
6,546,633 B1 * 4/2003 Lovell et al. ..... 30/334

FOREIGN PATENT DOCUMENTS

| | | |
|---|---|---|
| DE | 29 39 896 | 5/1980 |
| DE | 40 28 579 | 3/1992 |
| DE | 198 50 689 | 3/1998 |
| DE | 197 46 447 | 4/1999 |

* cited by examiner

*Primary Examiner*—Hwei-Siu Payer
(74) *Attorney, Agent, or Firm*—Browdy and Neimark, P.L.L.C.

(57) ABSTRACT

A cutting tool with a linear oscillating drive has a handle body (1) and a knife (3, 4) which is guided therein and is displaceable in an oscillating manner in the longitudinal direction, the knife (3, 4), by means of a knife holder (4), being detachably connected via a clamping member to a transmission element, arranged in the handle body (1), of the linear oscillating drive. Since the knife holder (4) is cohesively connected, in particular sealed, together with a knife shaft (31), the cutting tool complies with the hygiene regulations for use in the foodstuffs sector.

7 Claims, 2 Drawing Sheets

Fig. 3
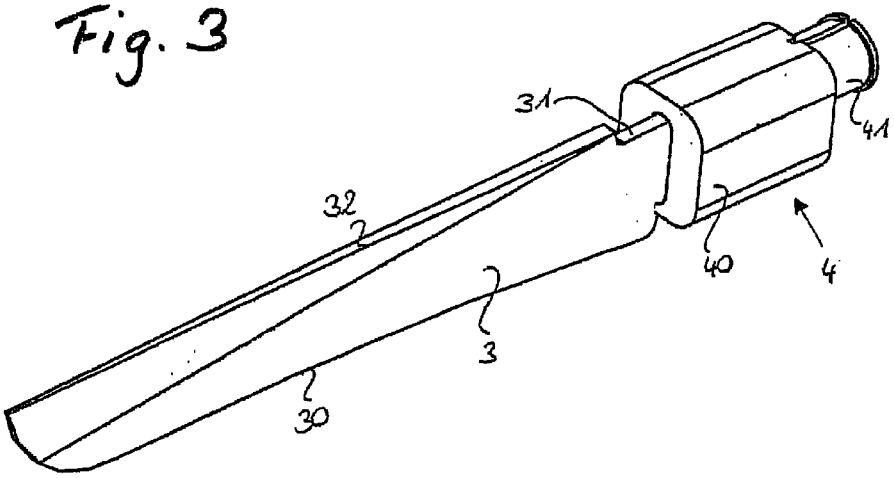
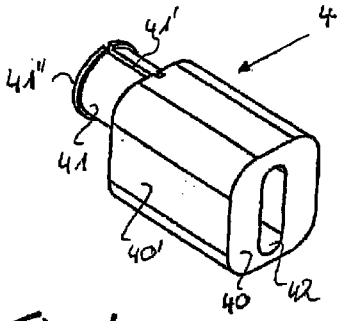
Fig. 4
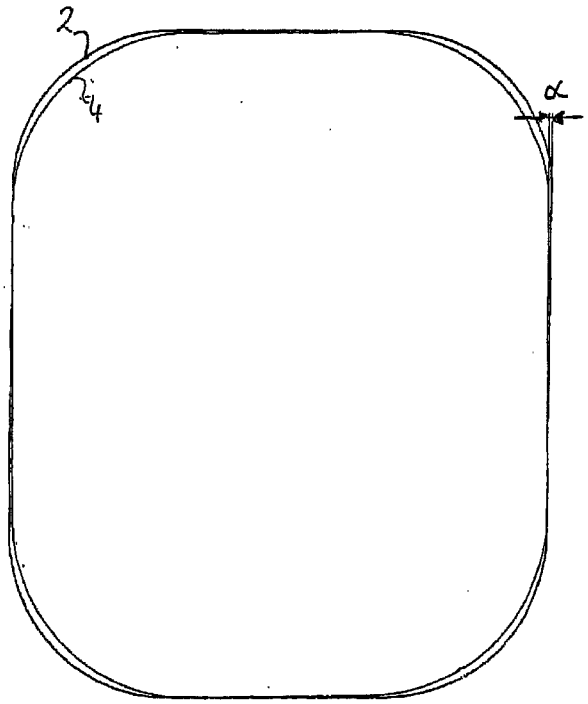
Fig. 5
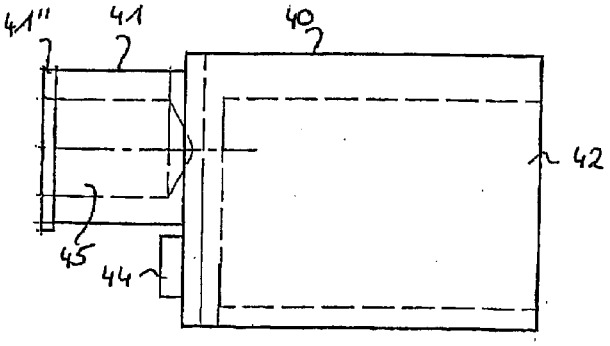
Fig. 6

CUTTING TOOL WITH LINEAR OSCILLATING DRIVE

FIELD OF THE INVENTION

The invention relates to a cutting or sawing tool with a liner oscillating drive.

BACKGROUND OF THE INVENTION

Hand tools with a pneumatic linear oscillating drive have been disclosed, for example, by DE-A-197 46 447, these hand tools being used for filing, sawing, polishing or cutting. The oscillating drive has a piston mounted in a displaceable manner in a handle body and having a piston rod, to the free end of which a tool holder is fastened. The piston is generally driven by a flutter valve.

The tool holder for such a hand tool is disclosed in more detail in DE-A-2 939 896. It essentially comprises a basic body having a T-shaped cross section, on the front and rear ends of which clamping pins are integrally formed. The tool holder has a through-hole, into which a tool shaft is inserted from one side and the piston rod of the linear oscillating drive is inserted from the other side. The shaft and piston rod can be fixed in the clamping pins by means of clamping collars. The tool holder is mounted in a C-shaped mounting piece arranged on the handle body. The mounting piece absorbs forces acting transversely to the direction of movement of the tool, so that the bearings of the piston rod in the interior of the housing are relieved.

Such hand tools are not very suitable as cutting tools, in particular knives or saws, for the foodstuffs sector, since the tool holder is quickly contaminated and is difficult to clean. Hygiene regulations are therefore not complied with. In addition, cutting residues stuck in the tool or knife holder impair the operability of the tool.

Furthermore, lateral forces occur when using knifes, in particular large butchers knives or saws, on account of the relatively long lever arm and on account of the relatively large working surface of the knife, and these lateral forces can only be absorbed in an inadequate manner by a C-shaped mounting piece. The knife "flutters" when subject to high stress.

SUMMARY OF THE INVENTION

It is therefore an object of the invention to provide a cutting tool which has a linear oscillating drive and can also be used in the foodstuffs sector.

A further object of the invention is to provide a cutting tool which withstands high lateral loads.

According to the invention, the knife holder and knife shaft are cohesively connected together, in particular sealed. The knife blade and knife holder can therefore be jointly removed from their handle body for cleaning.

It is advantageous that knife blades from series production can be used for this. This is especially advantageous, since the knives have to be used frequently.

The knife holder preferably has an essentially parallelepiped-shaped basic body which is mounted in a displaceable manner in a rectangular knife guide of the handle body. As a result, lateral forces which occur even in the case of large and long knives can be absorbed by the knife guide in order to relieve the transmission element of the linear oscillating drive.

A knife guide which is in one piece and has a locating opening with rounded-off corners for the basic body permits cost-effective production.

If the outer corners of the basic body and the inner corners of the knife guide are rounded with different radii of curvature, large destructive forces in the corner regions of the mounting can be prevented during canting or twisting of the knife.

Further advantageous embodiments follow from the dependent claims.

BRIEF DESCRIPTION OF THE DRAWINGS

The subject matter of the invention is explained in more detail below with reference to an exemplary embodiment which is shown in the attached drawings, in which:

FIG. 3 shows a knife with a knife blade and a knife holder according to FIG. 1;

FIGS. 4 and 6 show a knife holder according to FIG. 3, and

FIG. 5 shows a cross section through the knife holder and the knife guide according to FIG. 1 in an enlarged representation.

DETAILED DESCRIPTION OF THE PREFERRED EMBODIMENTS

Figure 1:
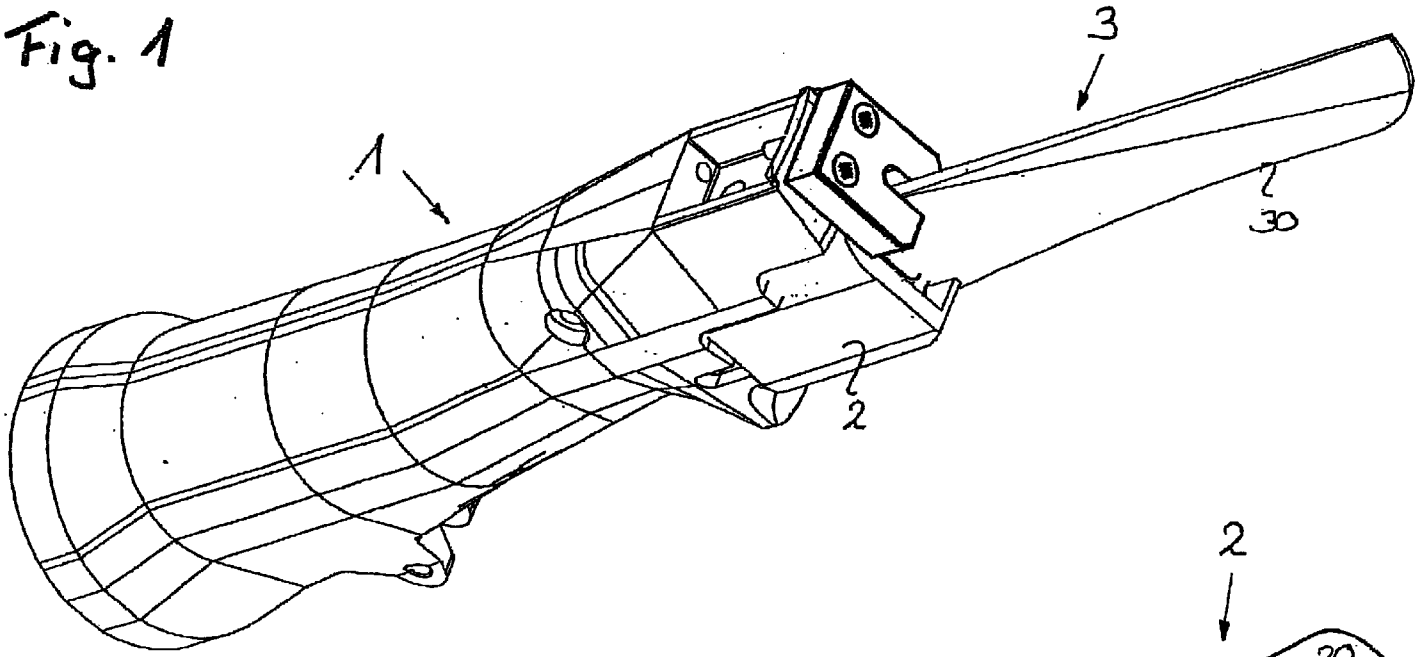
FIG. 1 shows a perspective representation of a cutting tool according to the invention.

A cutting tool according to the invention having a linear oscillating drive is shown in FIG. 1. It essentially comprises a handle body 1 and a knife which is guided therein and is displaceable in an oscillating manner in the longitudinal direction of the handle body 1, and of which the knife blade 3 with its cutting edge 30 can be seen in FIG. 1. The linear oscillating drive arranged in the handle body 1 is constructed as in the prior art mentioned at the beginning and is therefore not described again here.

Figure 2:
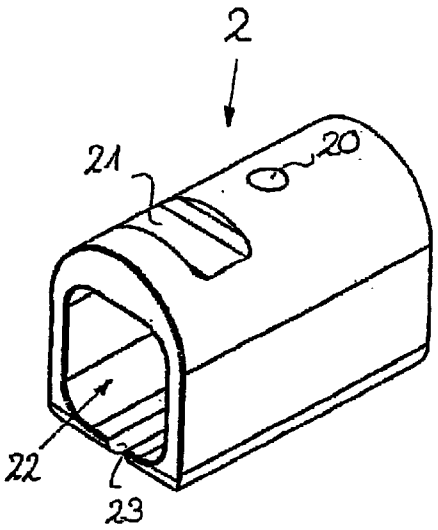
FIG. 2 shows a knife guide according to FIG. 1.

The knife is mounted in a knife guide 2 fixed in the handle body 1. The knife guide 2 according to FIG. 2 consists of a hollow body having an essentially cake-shaped cross section. It is preferably made of aluminum with a hard coating, since the latter is protein-repellent and is therefore especially suitable for use in the foodstuffs sector. A tapped hole 20 penetrates a surface of the knife guide 2 and enables the knife guide 2 to be fastened to the handle body 1 by means of a screw. Furthermore, in FIG. 2, a groove 21 is made in this surface. This groove 21 is optional. The knife guide 2 is preferably produced in one piece. It has an essentially rectangular locating opening 22 and a slot 23 running in the longitudinal direction and projecting right into the locating opening 22. In this case, the slot 23 is arranged on the side opposite the tapped hole 20.

As shown in FIG. 3, the knife consists of a metal knife blade 3 having an integrally formed shaft 31 and a knife holder 4 cohesively connected to the shaft 31. The knife blade 3 is a commercially available part which is suitable for the desired range of use.

According to FIGS. 4 and 6, the knife holder 4 has an essentially parallelepiped-shaped basic body 40 and a clamping pin 41 integrally formed thereon. The basic body 40, and the clamping pin 41 too in this case, is preferably made of a plastic having a good sliding behavior, in particular carbon-fiber-reinforced polyamide 6.

The clamping pin 41 has a hole 45 for accommodating a transmission element (not shown here) of the linear oscillating drive. The transmission element is preferably a piston rod. However, other types of transmission are also possible.

The piston rod is detachably fixed in the clamping pin 41 by means of a clamping collar (likewise not shown) with clamping screws. In order to permit the insertion and the clamping in place, the clamping pin 41 has a slot 41' running in the longitudinal direction. So that the clamping collar is not displaced in the longitudinal direction, the clamping pin 41, at its end remote from the basic body, has an encircling bead 41". Furthermore, as can be seen in FIG. 6, a stud 44 which serves as an anti-rotation locking means for the clamping collar is integrally formed on the basic body.

The basic body 40 has a knife receptacle 42 for accommodating the knife shaft 31. This knife receptacle 42 is preferably an elongated opening. When the knife is being produced, the shaft 31 of the knife blade 3 is now inserted into the knife receptacle 42 and is cohesively connected, preferably sealed, together with the latter at the end face. A plastic having adhesive properties, in particular a casting resin, is advantageously used for this purpose. Polyurethane (PU) is also possible.

For the operation of the cutting tool, the knife is inserted with its knife holder 4 into the knife guide 2 and fixed to the piston rod. In this case, the rear part of the cutting edge 30 of the knife 3 projects from the slot 23 of the knife guide 2. In a preferred embodiment shown here, the locating opening 22 of the knife guide 2 and also the basic body 40, mounted therein, of the knife holder 4 have rounded-off corners. In this case, the corners of the basic body 40 have a larger radius of curvature than the corners of the locating opening 22. The difference is typically 10%; for example the radii of curvature are at least approximately 5 mm and 5.5 mm, respectively. This achieves the effect that, at an angle of twist $\alpha$ or during canting of the knife of up to 0.5°, most of the forces are transmitted via lateral sliding surfaces 40' of the basic body 40 to lateral sliding surfaces of the knife holder 2 and the curved regions are not subjected to any excessive forces. This rectangular mounting with rounded-off corners could also be used with a different tool fastening. For example, the mounting piece described in DE-A-2 939 896 could be replaced with the knife guide and the tool holder could be replaced with the knife holder, the knife holder in this case being provided with a clamping pin on both sides.

By virtue of the connection according to the invention between the knife blade and the knife holder, a tool which is simple to clean is provided, and this tool, in the fastening region of the knife in the handle body, has an essentially closed surface exposed to the cut material. In the above description, an example with a knife blade has been explained. However, the knife blade can be replaced with a saw blade or another material-cutting tool without constructional changes.

List of Designations

1 Handle body
2 Knife guide
20 Tapped hole
21 Groove
22 Locating opening
23 Slot
3 Knife blade
30 Cutting edge
31 Knife shaft
32 Back
4 Knife holder
40 Basic body
40' Sliding surface
41 Clamping pin
41' Slot
41" Bead
42 Knife receptacle
44 Stop stud
45 Hole
$\alpha$ Angle of twist

What is claimed is:

1. A cutting tool adapted for use with a liner oscillating drive, said cutting tool having a handle body and a knife which is guided therein and is displaceable in an oscillating manner in longitudinal direction, said knife having a knife holder, said knife holder being detachably mounted in said handle body wherein said knife holder is cohesively connected to a knife shaft of the knife, and wherein the knife holder consists of an essentially parallelepiped-shaped basic body and a clamping pin integrally formed thereon.

2. The cutting tool as claimed in claim 1, wherein said basic body of the knife holder has a knife receptacle for inserting a blade of the knife, the knife receptacle being sealed when the blade is inserted.

3. The cutting tool as claimed in claim 2, wherein the knife receptacle is sealed with a casting resin.

4. The cutting tool as claimed in claim 1, wherein the basic body is made of polyamide 6 reinforced with carbon fibers.

5. The cutting tool as claimed in claim 1, wherein a positionally stable knife guide, which has an essentially rectangular locating opening for accommodating the knife holder, is arranged in the handle body.

6. The cutting tool as claimed in claim 5, wherein the basic body and the locating opening have rounded-off corners, said corners of the basic body having larger radii of curvature than said corners of the locating opening.

7. The cutting tool as claimed in claims 6, wherein the knife guide has a slot, through which a rear part of a blade of the knife projects.

* * * * *